US006682387B2

(12) United States Patent
Choi

(10) Patent No.: US 6,682,387 B2
(45) Date of Patent: Jan. 27, 2004

(54) INTERACTIVE TOYS

(75) Inventor: Kei Fung Choi, Causeway Bay (HK)

(73) Assignee: Silverlit Toys Manufactory, Ltd. (HK)

( * ) Notice: Subject to any disclaimer, the term of this patent is extended or adjusted under 35 U.S.C. 154(b) by 91 days.

(21) Appl. No.: 10/021,946

(22) Filed: Dec. 13, 2001

(65) Prior Publication Data

US 2002/0077024 A1 Jun. 20, 2002

Related U.S. Application Data

(60) Provisional application No. 60/256,019, filed on Dec. 15, 2000.

(51) Int. Cl.[7] ..... A63H 30/00; A63H 33/26; A63H 3/28; A63H 13/00

(52) U.S. Cl. ..... 446/175; 446/129; 446/297; 446/357

(58) Field of Search ..... 446/175, 297–301, 446/390, 391, 392, 393, 357

(56) References Cited

U.S. PATENT DOCUMENTS 3,867,786 A * 2/1975 Greenblatt ..... 446/130
4,938,483 A * 7/1990 Yavetz ..... 463/5
5,281,143 A * 1/1994 Arad et al. ..... 434/185
6,089,942 A * 7/2000 Chan ..... 446/175
6,110,000 A * 8/2000 Ting ..... 446/302
6,309,275 B1 * 10/2001 Fong et al. ..... 446/297
6,439,947 B1 * 8/2002 Lehavi ..... 446/101

FOREIGN PATENT DOCUMENTS

CA 2225060 * 10/1998
WO WO 0015316 * 3/2000

* cited by examiner

*Primary Examiner*—Derris H. Banks
*Assistant Examiner*—Faye Francis
(74) *Attorney, Agent, or Firm*—Greenberg Traurig, LLP; Charles Berman, Esq.

(57) ABSTRACT

A pair of toys or novelty devices for moving relative to the surrounding environment comprises a body for each toy. The body of at least one of the toys or devices to be capable of movement over a surface. A switch with the body activates a magnet to react from one state to another state, and in the second state causing at least one of the devices or toys to move relatively closer together in the surrounding environment. A microprocessor circuit with the body is connected with the magnet such that the switch causes the magnet to operate from one state to another state. When there are a pair of toys, which appear as pets, which get together, and when they appear to kiss each other, there is emitted a kissing sound. Then the cheeks of the pets glow and become red color, resembling the human emotion and reaction.

19 Claims, 3 Drawing Sheets

INTERACTIVE TOYS

This application claims the benefit of provisional application 60/256,019 filed on Dec. 15, 2000.

BACKGROUND OF THE INVENTION

This invention relates to a system for enabling an object, preferably toys or novelty items, to perform a series of actions.

Many toys or novelty items are available in the market which can perform different actions. It is known to have novelty devices and toys respond to initiations and actions in different manners. Also, it is known to use a remote control device to effect a specific action of a toy object, for instance a movable toy or novelty device. The instructions from the control systems are communicated by either infrared, sound or radio. The novelty device, toy or different reactive toys may perform different individual or separate actions or reactions with each other.

Having a toy or novelty item or series of toys which can respond in a unique manner would have distinct advantages and benefits in the consumer market.

The invention is directed to overcoming the limitations of existing toys and novelty items.

SUMMARY OF THE INVENTION

The invention provides for at least one, and preferably, a pair of interactive toys or novelty items. Activation of one or more of the toys or novelty devices by a user, for instance, by pressing one or more buttons on a device can cause the toy or novelty device to perform a series of actions. These actions include movement of the toys towards each other. These actions can preferably be accompanied by selected sound effects and light reactions.

According to the invention, there are a pair of toys. Each toy includes a body, which is preferably shaped as an animal character or a pet, for instance, a bear or a rabbit. At least one toy has a magnet for actuating a motion of one of the pair of toys to cause the reactive movement towards each other, preferably to touch each other under the magnetic attraction of the magnet. One or both of the toys includes a control facility whereby it generates one or more sounds. Thus, the toys appear sensitive to each other when they touch each other either by creating a noise or sound. The response of the devices can be cumulative. When the pair of toys, which appear as pets, get together, and they appear to kiss each other, there is emitted a kissing sound. Then the cheeks of the pets glow and become red color, resembling the human emotion and reaction.

There is at least one switch in at least one of the toys in the pair which operates as a control switch for operation by the user of the toy. The switch is connected to a programmed microprocessor for translating the received signals from the switch into control signals for operating the processor to cause the generation of noise and/or light and/or further movement of one or more magnets. When one or more magnets moves relatively closer together relative to the other magnet, this can cause the bodies with which they are mounted to move relatively to each other. This movement can be closer together.

In a preferred form of the invention there is a microprocessor which includes a memory function in which predetermined instructions for action, light and sound effects can be stored. These functions can operate according to the relative position of the toys to each other.

The invention is further described with reference to the accompanying drawings.

DETAILED DESCRIPTION OF THE DRAWINGS

There is a first toy for moving relative to a second toy, which can also move if desired. The toys comprise a body, and at least a portion of the body is capable of movement. A switch activates a magnet. The magnet is with at least the first toy, and the magnet is movable from a first position to a second position. In the second position at least a portion of the second toy moves relatively closer relative to the first toy.

There can also a movable feature of the body of the first toy, and the movable feature is selectively at least one of eyelids or ears.

A microprocessor circuit with the body of at least one character toy, or both character toys is connected with the magnet such that the switch causes an activation step. A program in the microprocessor circuit operates selectively with a motor, a sound generator, and a light-emitting device. The program creates the activation step which is at least one of a moving action, sound, or light. The sound is created by the sound generator associated with the body, and the light is effected by the light-emitting device. Moving action is selectively effected by the magnetic attraction. In other cases there can be a motor in the toy. The microprocessor is programmed to generate at least one of a different movable action or sound effect in response to signals received from the microprocessor.

Operating the electronic circuit causes the magnet to move thereby causing movement of a physical element on the toy character in response to the action of the magnet. This permits the physical element to move relative to a surface on which the device is located.

Features on the body can also be moved by the operation of the electronic circuit.

The electronic circuit can selectively have at least one, and preferably two, preset action programs in the electronic circuit.

A pair of toys in the form of two animal characters move relative to the surrounding environment. Each character comprises a body for each toy character, and an activation of the toy is effected after activating a switch with the body of at least one of the toys to cause a magnet with at least one of the toys to react from one state to a second state. When the magnet is in the second state it causes at least one of the toys to move relatively closer to the other toy. A light source in at least one of the toys is caused a glow in at least of the pet toys, and a sound generator in at least one of the toys emits a sound from at least of the toy pets. The sound can be of a kiss and the light source can generate a glow resembling an emotion, selectively red, to depict shyness. The light color could be determined collectively with the color of the body of the toy.

Figure 1:
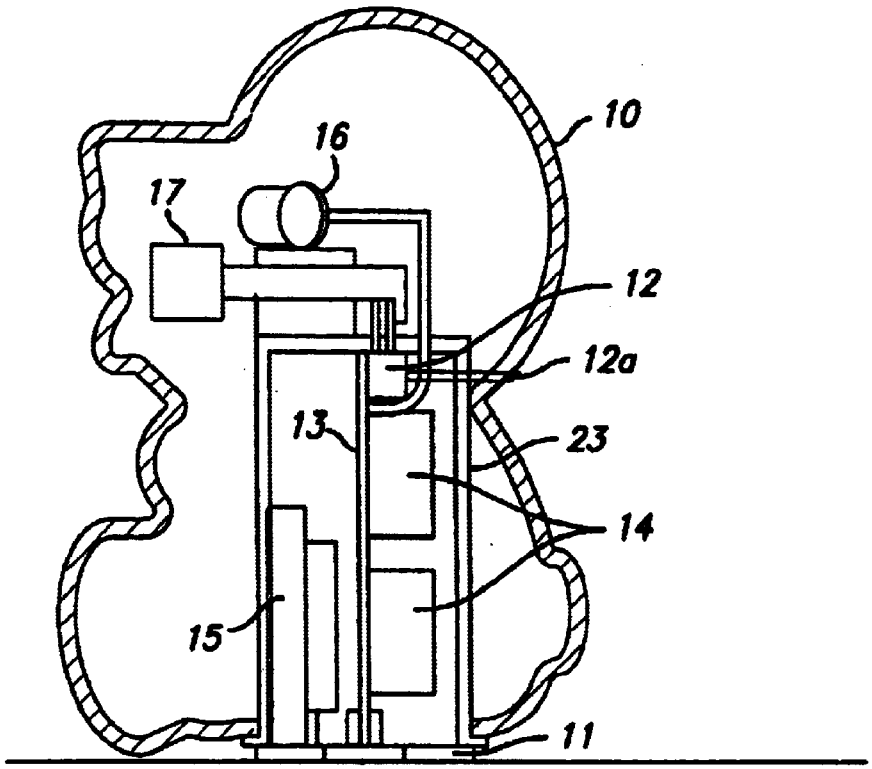
FIG. 1 is a side cross-sectional view of an interactive toy pet in the sense of a character having a body, eyes, nose, mouth, tummy, legs and ears.

As shown in FIG. 1 there is a cross-sectional view of a toy such as an animal character or pet bear, cat, dog or the like. There is a body 10 which is made of plastic or the like. Inside the body there is a housing 11 which mounts a macro switch 12 and a printed circuit board 13. There are also three AG13 button cell battery units 14. There is a mylar speaker element 15 under control of an electric circuit. There is also an LED 16 which turns on and off under the control of the electric circuit.

In the body there is also an LED 16 and a magnet 17. The magnet 17 can move forwardly and rearwardly as indicated by arrow 18. Triggering the switch 12 through control button 12*a* as necessary operates the magnet 17. The magnets 17 are mounted on a non magnetic base so as to facilitate the movability of the magnets in a rearward or forward manner.

The magnets are also mounted on or with a lever of an individual product or toy to facilitate the movability of the magnets in a forward manner when the 2 magnets are brought closer together. This then triggers the leaf switch 12. This in turn closes a circuit associated with CPU which in turn causes the sound and light effects. When the magnets are not in the forward position, the mounting for the magnets, which can include a spring biased system causes the magnets to move rearwardly.

Figure 2:
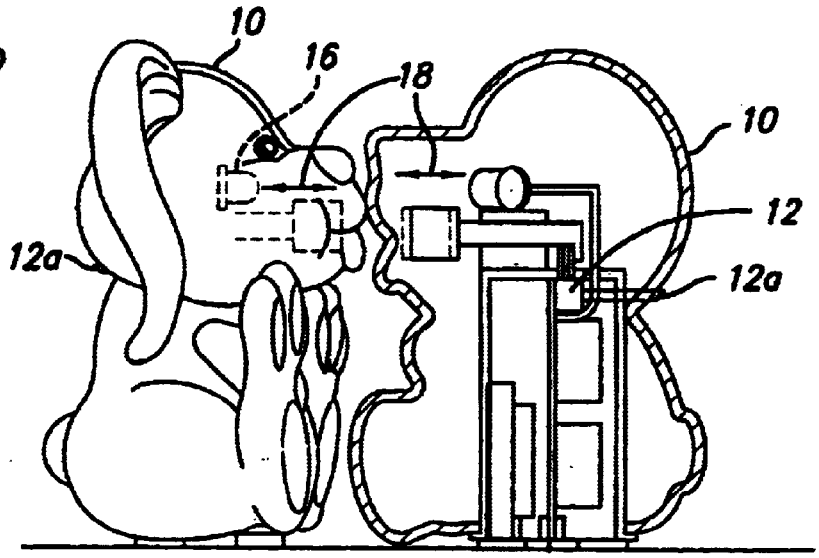
FIG. 2 is a side view of two of the figures showing the pair of toys. One toy is in cross-section.

The invention includes two devices or toys as shown. Each device is representative of an animal or human shape. They are arranged so that they kiss each other as shown in FIG. 2. There will be a sound effect of kissing or other sound effect from the speaker 15 when the two devices come into abutting relationship. The abutting relationship is caused by the magnets 17 in each of the devices which pull relatively towards each other. There is also a sound effect from the speaker as necessary. The LED 16 turns red and thereby causes the shell 10 of the body to glow red, which may show embarrassment or shyness as necessary.

Figure 3:
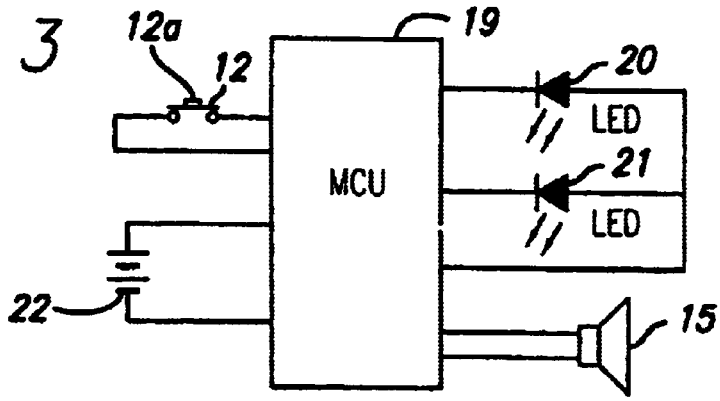
FIG. 3 is a schematic view of the microprocessor circuit with the other electrical components of the system.
Figure 4:
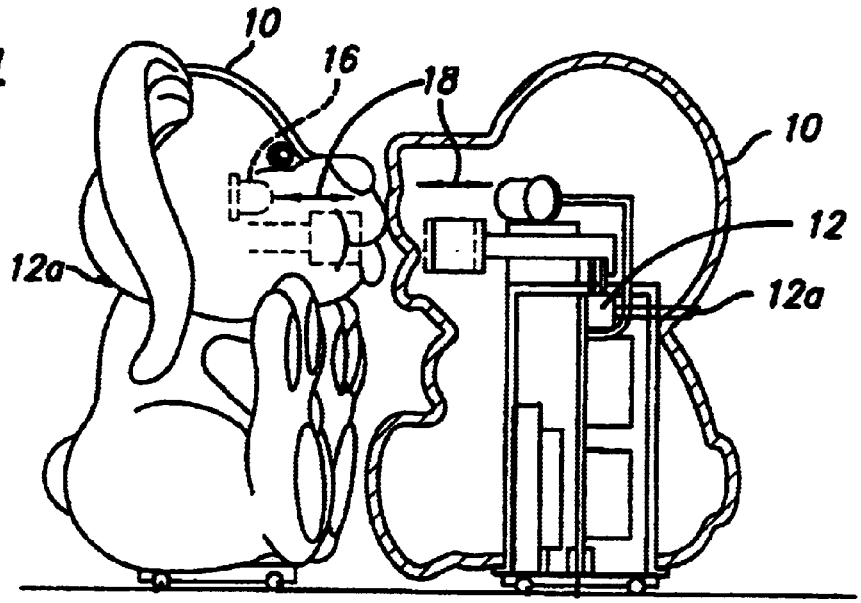
FIG. 4 is a side view of two of the figures showing a pair of toys. One toy is in cross-section. The toys here use a different configuration of components.
Figure 5:
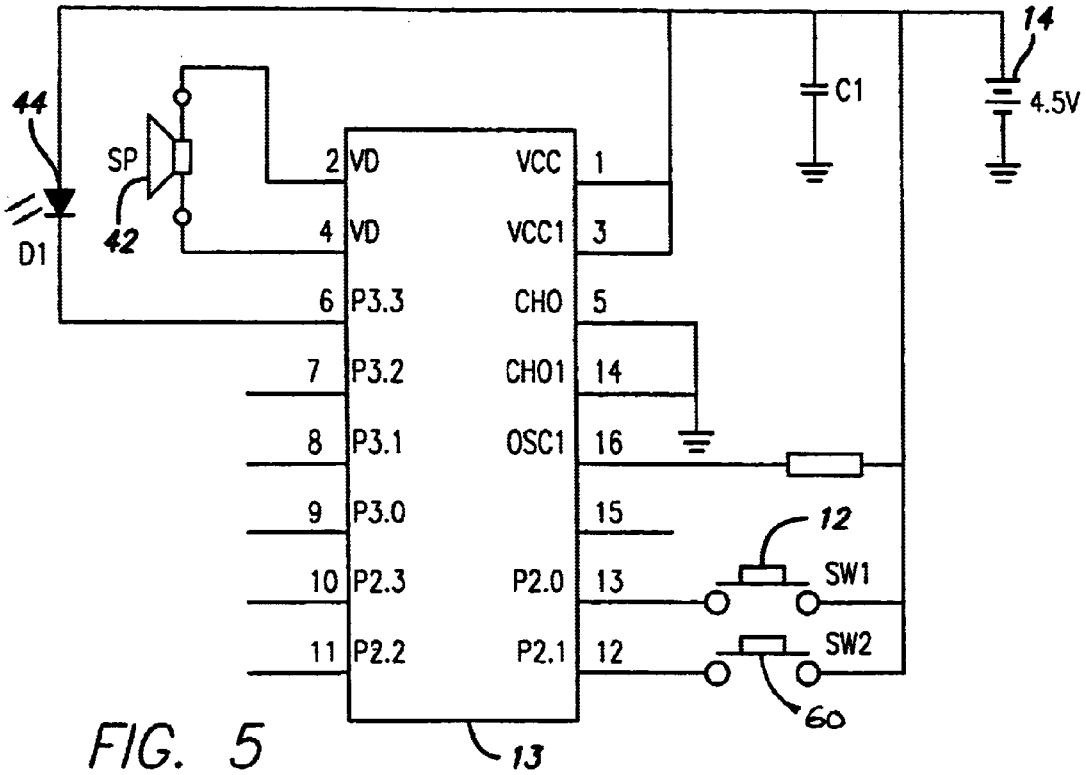
FIG. 5 is a schematic of a microprocessor with the other electronic components of the system.

The circuit board 15 also includes a circuit 19 and the switch 12 as shown as operational under the action of the magnet movement. The LED 16 of FIG. 1 is shown in FIG. 3, respectively, by two LEDs 20 and 21, which could be on two different sides of the body. As necessary those LEDs 20 and 21 may be different colors. The coloring effect can be created by the color of the body 10. A suitable battery 22 is used to power the system LEDs and the speaker 15 as shown in FIG. 3.

The body portion 10 includes a right foot or leg, a left foot or leg, a left arm, and a right arm. The face includes a left eye and a right eye. There are also ears. The central portion of the body 10 includes a tummy section and there can be a sensor switch. Access to the interior of the toy is obtained, by molding the toy in two parts which snap closed together or open as necessary, for instance for replacement of the batteries. This permits access to at least part of the device for replacing batteries as the case may be. The base 11 is smooth and can permit sliding of the toy over the surface.

Figure 6:
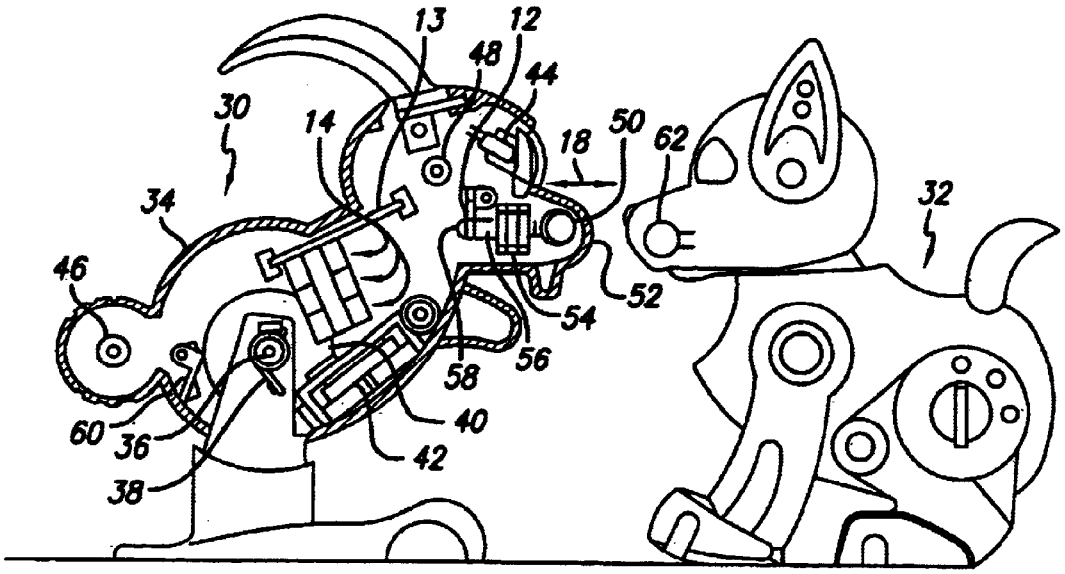
FIG. 6 is a side view of two figures showing a pair of toys. One toy is in cross-section. The toys here use a different configuration of components.

In FIG. 6 there is shown two other characters using the concepts of the invention.

In FIG. 6 on the left hand side there is a cross-sectional view of a first kind of animal 30. On the right hand side there is a cross-sectional side view of a second kind of animal 32.

The shell 34 of the body of 30 is made in two component parts which can be separated. The component parts made together in a suitable snapping action and can be separated as necessary. The body shell 34 is mounted in rocker or spring-like fashion on a pivot 36 so that the animal 30 can move forwardly and backwardly about the pivot 36. There is a torsion spring 38 which is formed to hold the body 34 in a relatively upright manner as illustrated.

When the two shells of the body are separated, access to the interior of the animal 30 can be obtained. Mounted in the interior of the animal is the printed circuit board 13 and associated with that board are the three button cell batteries 14. Connected with the system there is electrically connected through wire 40, a speaker 42. The results are electrically connected LED 44, the connection being with the print circuit board 13.

The system for snapping together the two component parts is shown at two pins 46 and 48 which would mate with associated sockets on the other half portion of the animal body.

A magnet 50 is mounted in the forward part near the nose 52 of the animal. Suitable support base 54 is mounted with the magnets so that the magnets 50 can move forwardly and rearwardly as indicated by arrow 18. The mounting 54 can be of a non-magnetic material and the magnet 52 is held in a suitable support bracket 56. The remote end 58 of the bracket 56 is connected with a leaf switch 12 for operation forwardly and backwardly as the magnet itself moves in direction 18. In the rearward position the switch which is electrically connected with the ICB 13 would keep the ICB in a deactivated state. In the forward position of the switch 12, the ICB circuit is closed and an activation step takes place. The activation step can selectively be switching on of the LED 44 or the speaker 42.

In FIG. 6, there is another leaf switch 60 which is located at the bottom/rear part of the toy. With this switch, when the product or toy is being played with as an individual toy, namely without another toy, when the product or toy is pressed, the leg of the toy triggers the rear leaf switch 60 to also activate sound and light effect through the CPU.

The second animal 32 also has a magnet 62 in the forward portion of the animal 32. It may have similar mechanisms internally as is portrayed with animal 30. Alternatively it may just have a mechanism of the battery 62 which is relatively stationary.

An ON/OFF configuration for the device can be effected by a plastic tag which is provided for deactivating the device should the magnet be inadvertently pulled forward, for instance by magnetic attraction to another metal part, for instance a fridge, scissors or a stapler.

In the configuration of FIGS. 2 and 3 the batteries 14 are located inside the toy body. A vertically contained element 23 extends from the base 11 of the body towards the top of the body. On that element 23 there is mounted the microprocessor electronic circuit board for operating different features of the invention. The battery, and there may be more than one, powers the microprocessor circuit board, speakers and LEDs.

The microprocessor board can include a main control unit and comparator circuit connected with the respective magnet devices. The magnet devices are preferably permanent magnets.

In some embodiments they could be electromagnets. The system operates such that when the sensor switch on one of the devices, senses that the other device is sufficiently close, the battery powers the electromagnetic circuit to activate the magnetic effect. This will cause the two devices to move together under magnetic attraction when the two magnets affect the attraction force on each other.

Many other forms of the invention exist, each differing from the others in matters of detail only.

Although the invention is shown in relation to an animal character, it would also be operational with other toys, for instance, a vehicle. The operation of the toy which, in some cases can be a vehicle is such that it can move on the surface in a forward, rearward, left turn, right turn, or sideways with smaller or larger moves as programmed into the toy. Different stop actions are possible.

Motors can be operational through gear wheel mechanisms to operate the respective wheels. Power from the control board is directed through a series of conducting cables to the motors, and in turn, the gear mechanisms. Gear mechanisms can include three or more interlocking gears which activate respective wheels. The microprocessor also controls a light source LED control unit, which is operational under given programmed conditions of the processor.

There can also be more speakers or other sound generating devices which are operational under the control of the microprocessor. Sound effects can include speech, song, music, screeching, honking, speeding, acceleration, engine noise and other verbal sounds. These sounds can be related to the action of the toy, novelty device or, for instance, different pets, animals or a car.

Instead of a sliding surface there can be other elements, such as rollers, for engaging the surface through which the device, toy, animal or car will move in response to the magnetic action.

Multiple other magnetic arrangements can be provided in one or more of the toys or devices so that the response of the device is a combination effect of one or more of the magnets. The sound and color reactions emanating from these devices can be determined by the microprocessor. The responses to the magnet can be movement on a surface, sound and/or other movement or action by that device. With different toys the sound and light effects can be different. Only one of the toys of a pair or more toys may move. One type may move relative to a stationary reaction element. In some cases there is a magnet in only one of the devices, and there is a static or magnetic, metal responsive device or element in the other device.

The electromagnetic effect of one of the magnets may be of a nature to switch a magnet on or off and thereby cause the movement of the toy, rather than to cause the magnet to move from one position to another. In other cases just a portion of the body of the toy moves in response to the activation of the magnet. In some cases the body does not move and the relative pre-positioning of the two bodies permits a relationship such that when the magnets move, a light is activated and/or a sound is activated thereby to obtain a novel effect.

The scope of the invention is determined by the following claims.

What is claimed is:

1. A first toy for moving relative to a second toy, wherein the first toy comprises:

a body for the first toy;

at least a portion of the body of the first toy being capable of movement;

a first switch with the body of the first toy for activating a magnet, the magnet being with the first toy, and the magnet being movable from one physical position to a second physical position within the body of the first toy, and in the second position causing at least a portion of a second toy to move relatively closer relative to the first toy;

a microprocessor circuit with the body, the microprocessor circuit being connected through the first switch with the magnet such that the first switch causes a further activation of the toy; and a second switch operational independently of the first switch operational with the magnet, the independently operational second switch acting to close the circuit.

2. A device as claimed in claim 1 including a movable feature of the body of the first toy, the movable feature being selectively at least one of eyelids or ears.

3. A device as claimed in claim 1 including a program in the microprocessor circuit, a sound generator, and a light-emitting device, the program being for effecting signals to effect the activation, the activation being at least one of a moving action, sound, or light, the moving action being selectively effected by a motor, the sound being created by the sound generator associated with the body, and the light being effected by the light-emitting device.

4. A device as claimed in claim 1 wherein the microprocessor is programmed to generate at least one of a different light action or sound effect in response to signals received from the microprocessor.

5. A toy as claimed in claim 1 wherein the toy is mounted for rocking motion about the pivot mounting, and including a spring for holding the body of the toy normally in a relatively upright manner, and wherein under action of a user the toy is caused to rock about its pivot.

6. A toy device for moving relative to the surrounding environment, wherein the toy comprises:

a body;

the body being capable of movement;

a magnet with the body for activating a first switch to react from one state to another state, and in the second state causing another device and the toy to move relatively closer together;

a microprocessor circuit with the body, the microprocessor circuit being connected with the magnet such that the first switch causes the magnet to operate from one state to another state; and a second switch operational independently of the first switch operational with the magnet, the independently operational second switch acting to close the circuit and cause the activation of at least one of a speaker and light source.

7. A toy as claimed in claim 6 wherein the magnet is a permanent magnet.

8. A toy as claimed in claim 6 wherein the toy is mounted for rocking motion about a pivot mounting, and including a spring for holding the body of the toy normally in a relatively upright manner, and wherein under action of a user the toy is caused to rock about its pivot.

9. A pair of toys, wherein at least one is for moving relative to the surrounding environment, wherein the toys comprise:

a body for each toy;

the body for at least one of the toys for being capable of movement;

a first switch with the body for activating an electronic circuit in response to movement of a magnet from a first position to a second position, and in the second position causing at least one of the toys to move relatively closer to the other toy;

the circuit being connected with the first switch such that closing the switch causes operation of the circuit; and a second switch operational independently of the first switch operational with the magnet, the independently operational second switch acting to close the circuit and cause the activation of at least one of a speaker and light source.

10. A pair of toys for moving relatively to each other, wherein the toys comprise:

a body for each toy;

the body of at least one of the toys being capable of movement over a surface;

a first switch with the body of at least one of the toys for activating a magnet in the respective toy to react from one state to another state, and the magnet in the second state causing at least one of the toys to move relatively closer to the other toy;

a microprocessor circuit with the body, the microprocessor circuit being connected with the magnet such that operation of the first switch causes the magnet to move from one state to another state; and a second switch operational independently of the first switch operational with the magnet, the independently operational second switch acting to close the circuit and cause the activation of at least one of a speaker and light source.

11. A toy as claimed in claim 10 wherein the magnet is a permanent magnet.

12. A pair of toys in the form of two animal characters for relative movement, wherein the toys comprise:

a body for each toy;

the body of at least one of the toys being capable of movement over a surface to move relatively towards each other;

a first switch with the body of at least one of the toys for activating a circuit with at least one of the toys when a magnet reacts from one state to a second state, such that when the magnet is in the second state at least one of the toys moves relatively closer to the other toy;

the circuit being connected with a second switch, the circuit additionally acting to active a light source in at least one of the toys to cause a glow in at least of the toys, and to cause a sound generator in at least one of the toys to active a sound from at least one of the toys; and a second switch operational independently of the first switch operational with the magnet, the independently operational second switch acting to close the circuit and cause the activation of at least one of a speaker and light source.

13. A pair of toys as claimed in claim 12 wherein the sound is that of a kiss and the color is a glow resembling an emotion, selectively red, to depict shyness.

14. A first toy for moving relative to a second toy, wherein the first toy comprises:

a body for the first toy;

at least a portion of the body of the first toy being capable of movement;

a first switch with the body of the first toy for activating a magnet, the magnet being with the first toy, and the magnet being movable from a first position to a second position movable from one physical position to a second physical position within the body of the first toy, and in the second position causing at least a portion of a second toy to move relatively closer relative to the first toy;

a microprocessor circuit with the body, the microprocessor circuit being connected through a first switch with the magnet such that the first switch causes a further activation of the toy; and a second switch operational independently of the first switch operational with the magnet, the independently operational second switch acting to close the circuit.

15. A toy for moving relative to the surrounding environment, wherein the toy comprises:

a body;

the body being capable of movement;

a magnet with the body for activating a first switch to react from one state to another state, and in the second state causing another device and the toy to move relatively closer together; and a microprocessor circuit with the body, the microprocessor circuit being connected with the magnet such that the first switch causes the magnet to operate from one state to another state, and a second switch operational independent of the first switch operation with the magnet, the independently operational second switch acting to close the circuit.

16. A pair of toys, wherein at least one is for moving relative to the surrounding environment, wherein the toys comprise:

a body for each toy;

the body for at least one of the toys for being capable of movement;

a first switch with the body for activating an electronic circuit in response to movement of a magnet from a first position to a second position movable from one physical position to second physical position within the body of the first toy, and in the second position causing at least one of the toys to move relatively closer to the other toy; and the circuit being connected with the first switch such that closing the switch causes operation of the circuit, and a second switch operational independently of the first switch operational with the magnet, the independently operational second switch acting to close the circuit.

17. A pair of toys for moving relative to each other, wherein the toys comprise:

a body for each toy;

the body of at least one of the toys being capable of movement over a surface;

a first switch with the body of at least one of the toys for activating a magnet in the respective toy to react from one state to another state, and the magnet in the second state causing at least one of the toys to move relatively closer to the other toy; and a microprocessor circuit with the body, the microprocessor circuit being connected with the magnet such that operation of the switch causes the magnet to move from one state to another state, and a second switch operational independently of the first switch operational with the magnet, the independently operational second switch acting to close the circuit.

18. A first toy for moving relative to a second toy, wherein the first toy comprises:

a body for the first toy, the body being mounted on a pivot for a rockable motion;

at least a portion of the body of the first toy being capable of movement;

a first switch with the body of the first toy for activating a magnet, the magnet being with the first toy, and the magnet being movable from one physical position to a second physical position within the body of the first toy, and in the second position causing at least a portion of a second toy to move relatively closer relative to the first toy;

a microprocessor circuit with the body, the microprocessor circuit being connected through the first switch with the magnet such that the first switch causes a further activation of the toy; and a second switch operational independently of the first switch operational with the magnet, the independently operational second switch acting to close the circuit and cause the activation of at least one of a speaker and light source, and the second switch being operational by having the body move in a rocking motion to effect switch closure.

19. A toy as claimed in claim 18 wherein the toy includes a spring for holding the body of the toy normally in a relatively upright manner, and wherein under action of a user the toy is caused to rock about its pivot.

* * * * *